US005416969A

United States Patent [19]

Miura

[11] Patent Number: 5,416,969

[45] Date of Patent: May 23, 1995

[54] SLIDING CONTACT PRODUCING METHOD

[75] Inventor: Akito Miura, Miyagi, Japan

[73] Assignee: Alps Electric Co., Ltd., Tokyo, Japan

[21] Appl. No.: 55,948

[22] Filed: Apr. 28, 1993

[30] Foreign Application Priority Data

May 11, 1992 [JP] Japan ..... 4-117598
Aug. 19, 1992 [JP] Japan ..... 4-220343

[51] Int. Cl.[6] ..... H01H 11/04

[52] U.S. Cl. ..... 29/622; 29/860; 29/879; 29/884; 200/257; 200/267; 219/121.64; 228/257

[58] Field of Search ..... 29/622, 860, 874, 877–879, 29/882, 884; 200/257, 267; 219/121.64; 228/49.1, 212

[56] References Cited

U.S. PATENT DOCUMENTS

| | | | |
|---|---|---|---|
| 1,105,489 | 7/1914 | Clement | 200/267 |
| 2,754,393 | 7/1956 | Clair, Jr. | 200/267 |
| 3,268,701 | 8/1966 | La Plante et al. | 200/267 |
| 3,780,247 | 12/1973 | Healy et al. | 200/267 |
| 4,345,372 | 8/1982 | Sekigawa et al. | 29/882 |
| 4,642,891 | 2/1987 | Weik et al. . | |
| 4,706,383 | 11/1987 | Saffari . | |

FOREIGN PATENT DOCUMENTS

| | | | |
|---|---|---|---|
| 20677 | 1/1990 | Japan | 219/121.64 |
| 2082943 | 3/1982 | United Kingdom | 29/622 |
| 2092383 | 8/1982 | United Kingdom | 200/267 |

*Primary Examiner*—P. W. Echols
*Attorney, Agent, or Firm*—Guy W. Shoup; Patrick T. Bever

[57] ABSTRACT

A sliding contact producing method is provided wherein noble metal balls are easily positioned on a metal plate; the weld strength between the noble metal ball and the metal plate can be obtained sufficiently; and a noble metal mounting jig can be prevented from damage when the metal plate is beam-welded with the noble metal ball. While being received in the recess portions of a jig, the noble metal balls are respectively contacted with bowllike recesses formed in the base surface of the metal plate. YAG laser beam is irradiated on the metal plate to weld the metal plate with the noble metal ball. Then the metal plate is sheared in a determined shape to form resilient strips. The present invention can improve welding operation efficiency and the reliability of welded portions. Since the metal plate being wider than that of the resilient strip receives beam, the metal contact mounting jig can be prevented from damage due to beam welding.

13 Claims, 6 Drawing Sheets

SLIDING CONTACT PRODUCING METHOD

BACKGROUND OF THE INVENTION

1. Field of the Invention

The present invention relates to a method of producing a sliding contact which is formed of a resilient strip and a noble metal ball and slides on a sliding substrate.

2. Description of the Related Art

The sliding contact shown in FIG. 12 has been known as a sliding contact for encoders used for so-called mouses. This type of sliding contact is supported by the supporting body 2 and is formed of a plurality of resilient strips 3 and a noble metal strip 4 of wear resistance. The supporting body 2 moves on a sliding substrate, for example, resistor 1 (or, a pulse switch substrate) in the direction shown with the arrow A in FIG. 12. The resilient strips 3 each have the front end extending to the resistor 1. The noble metal strip 4 is connected to the front end of the resilient strip 3 and has its front end contacting to the resistor 1. The resilient strips 3 are arranged in parallel so as to be perpendicular to the traveling direction of the supporting body 2.

However, the conventional sliding contact has the following disadvantages:

1) The processing is complicated since a large number of noble metal strips 4 must be arranged in line and bent portions are needed to contact with the resistor 1.
2) In order to obtain a sufficient contact strength between the noble metal strip 4 and the resilient strip 3, it is required to set large contacting area of the noble metal strip 4 and the length of the resilient strip 3 is relatively short. Therefore the pressure of the noble metal strip 4 against the resistor 1 is unstable because the degree of freedom of the resilient deformation of the resilient strip 4 is small, whereby the reliability as a contact is poor.
3) The manufacturing cost is high because the noble metal strip 4 requires a relatively large area other than the contact point and is formed of a special noble metal material having wear resistance and elastic properties.

The sliding contacts shown in FIGS. 13 to 15 have been proposed in order to solve the above problems.

FIG. 13 is a side view showing a sliding contact according to the proposal. FIG. 14 is a side view showing the state of making the main portion of the sliding contact in FIG. 13. FIG. 15 is a front view showing the state of making the main portion of the sliding contact in FIG. 13. In FIG. 13, like numerals are given to those identical to elements shown in FIG. 12. That is, numeral 1 represents a resistor and 2 represents a supporting body.

The sliding contact, as shown in FIG. 13, is constituted of a resilient strip 5 having its front end supported by the supporting body 2 and welded to the resilient strip 5, and a a noble metal ball 6 of wear resistant property contacting to the resistor 1. The resilient strip 5 is formed of, for example, a resilient material such as german silver, phosphor-bronze, or the like. The noble metal ball 6 is formed of, for example, Pt-series noble metal material, or Pd-series noble metal material.

In the sliding contact, when the noble metal ball 6, as shown in FIG. 14, is welded to the resilient strip 5, is positioned by arranging in the recess portion *7a* formed in the jig 7. The front end of the resilient strip 5 is placed on the noble metal ball 6. Then a so-called beam welding is performed by irradiating a YAG laser beam 8 onto the resilient strip 5. As a result, the resilient strip 5 is fused by the irradiation heat due to the laser beam 8 while the noble metal ball 6 is fused by the the heat conducted through the contact point P, whereby the resilient strip 5 is welded with the portion at the contact point P.

According to the above sliding contact, the resilient strip 5 is point-contacted with the noble metal ball 6 and there is an air gap between the resilient strip 5 and the noble metal ball 6 except for the contact point P. Therefore there has been a disadvantage in that if the irradiating position of the YAG laser beam 8 shifts somewhat from the top of the contact point P, the air gap 9 insulates the irradiation heat of the laser beam 8, thus causing insufficient fusion of the noble metal ball 6. As a result, the weld strength between the resilient strip 5 and the noble metal ball 6 is decreased largely.

FIG. 16 is a characteristic diagram showing the experimental correlation between laser beam irradiation position and weld strength obtained by the present inventor. In the Figure, the ordinate axis shows the weld strength between the resilient strip 5 and the noble metal ball 6 and the transverse axis shows irradiation positions of the YAG laser beam 8. In the irradiation position, the reference position (0) is one running through the contact point P and the center C of the noble metal ball 6. The positive shift (+) shows the irradiation position shifted in the elongate direction of the resilient strip 5 (to the right side in FIG. 13). The negative shift (−) shows the irradiation position shifted toward the front end of the resilient strip 5 (to the left side in FIG. 13).

In comparison with mean values shown with black dots in FIG. 16, for example, when YAG laser beam 8 is irradiated onto the top of the contact point P, or, at the reference position (0), the weld strength is 1858.25 gf. However if the irradiation position of the YAG laser beam 8 is shifted in the elongate direction or toward opposite side (−) of the resilient strip 5 by 0.05 mm, the weld strength decreases to 1676.5 gf. In the similar manner, if the YAG laser beam is shifted toward the front side (+) of the resilient strip 5 by 0.05 mm, the weld strength decreases to 1418.17 gf. Therefore, there has been a disadvantage in that when the irradiation position of the YAG laser beam 8 is shifted somewhat from the contact point P, the weld strength between the resilient strip 5 and the noble metal ball 6 reduces largely, as described above.

Furthermore, according to the above-mentioned sliding contact, when the YAG laser beam 8, as shown in FIG. 15, is irradiated onto the resilient strip 5, it may hit erroneously the jig 7 by deflecting out of the side end of the resilient strip 5, whereby the jig 7 may be partially damaged due to the irradiation heat of the YAG laser beam 8.

SUMMARY OF THE INVENTION

The present invention is made to overcome the above problems in the prior arts. An object of the present invention to provide a sliding contact where a resilient strip can be easily aligned with a noble metal ball and a strong weld strength can be obtained between the resilient strip and the noble metal ball.

Another object of the present invention is to provide a sliding contact producing method which can prevent a noble metal ball positioning jig from being damaged during beam welding.

In order to achieve the above object, a noble metal contact is mounted in a recess portion so as to contact partially it to the curved surface of the recess portion formed in a metal plate and then is beam-welded.

In order to achieve another object of the present invention, a plurality of metal contacts are arranged on a jig; a metal plate is arranged on the noble metal contacts; beam is irradiated onto the metal plate; the noble metal contacts are directly bonded to the metal plate by welding; and a resilient metal strip is formed by subjecting the metal plate to a slit processing so as to surround the noble metal contact.

According to the present invention, since a noble metal ball is partially received in a recess portion of a metal plate, it is possible to perform easily positioning between the resilient strip and the noble metal ball. In addition, since the surface of a noble metal contacts partially to the curved surface of the recess, the contact area between the recess portion and the noble metal ball is larger than the conventional contact point. Hence if the irradiation position of the laser beam deflects somewhat from a reference position, the irradiation heat of the laser beam conducts properly from the resilient strip to the noble metal ball by way of the contact point, whereby the weld strength between the resilient strip and the noble metal ball can be obtained sufficiently.

Moreover, according to the present invention, a plurality of noble metal contacts are arranged on a jig; a metal plate is placed on the noble metal contacts; the noble metal contacts are directly bonded with the metal plate through welding by irradiating beam onto the metal plate; and the metal plate is subjected to a slit processing to form resilient strips. Therefore, the beam is received by the metal plate wider than that of the resilient strip and does not reach the jig, whereby possible damage of the jig can be prevented during beam welding.

BRIEF DESCRIPTION OF THE DRAWINGS

The present invention will hereinafter be explained in more detail with reference to the attached drawings, wherein.

DESCRIPTION OF THE PREFERRED EMBODIMENTS

A preferred embodiment of the sliding contact producing method according to the present invention will be explained below in accordance with attached drawings.

Figure 1:
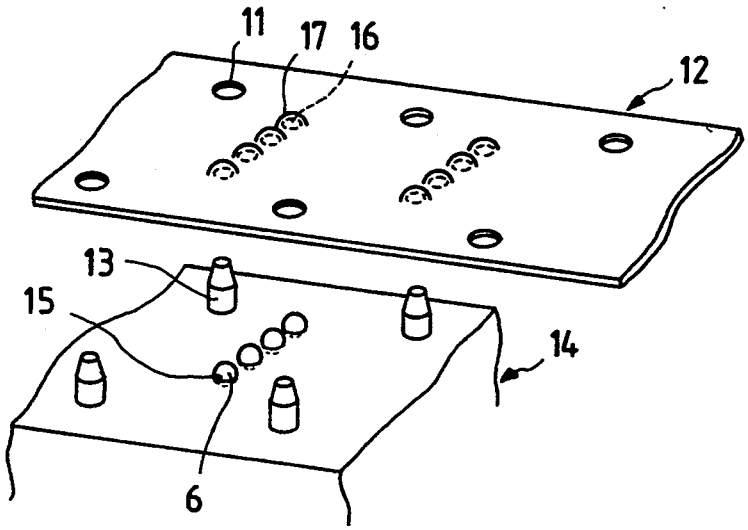
FIG. 1 is a perspective view illustrating an embodiment of the sliding contact producing method according to the present invention.
Figure 2:
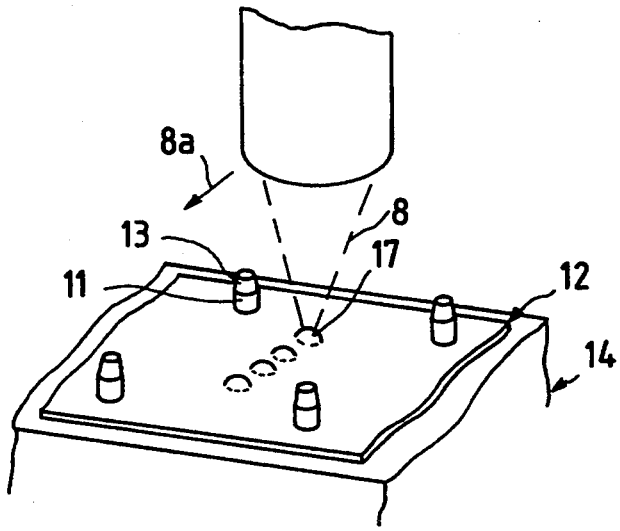
FIG. 2 is a perspective view showing the state of beam-welding the sliding contact in FIG. 1.
Figure 3:
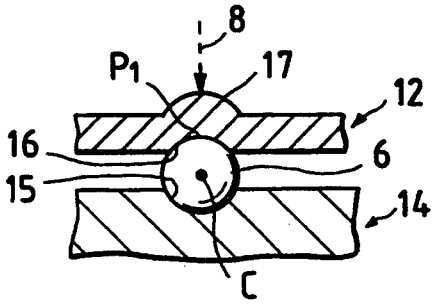
FIG. 3 is a cross-sectional view showing a main portion of the sliding contact in FIG. 1 which is beam-welded.
Figure 4:
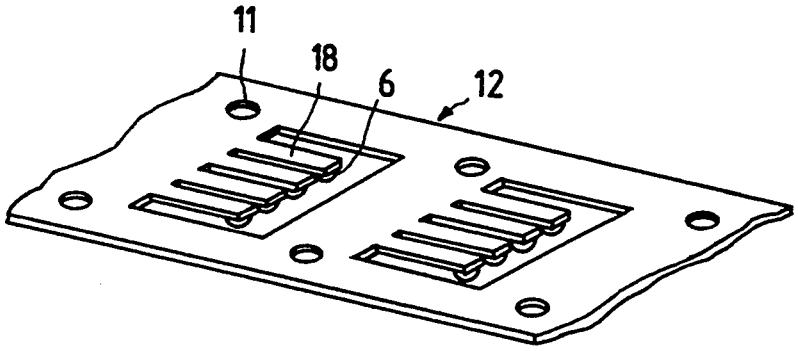
FIG. 4 is a perspective view showing the metal plate in FIG. 1 sheared out in a predetermined shape.
Figure 13:
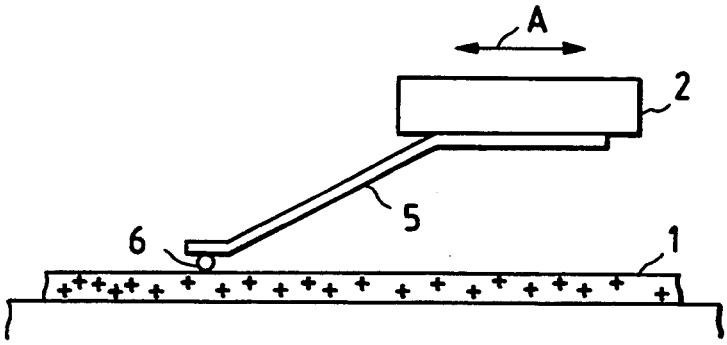
FIG. 13 is a side view showing the sliding contact according to the present invention.
Figure 14:
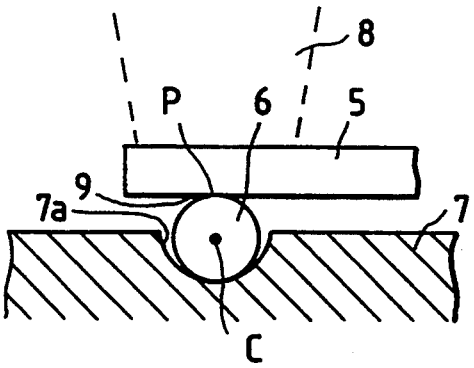
FIG. 14 is a side view showing a step of making the main portion of the sliding contact in FIG. 13.
Figure 15:
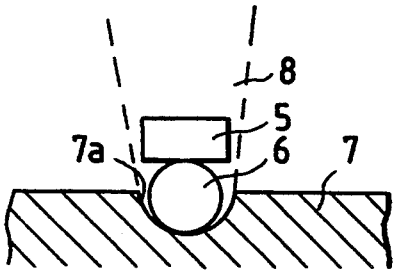
FIG. 15 is a front view showing a step of making the main portion of the sliding contact in FIG. 13.
Figure 16:
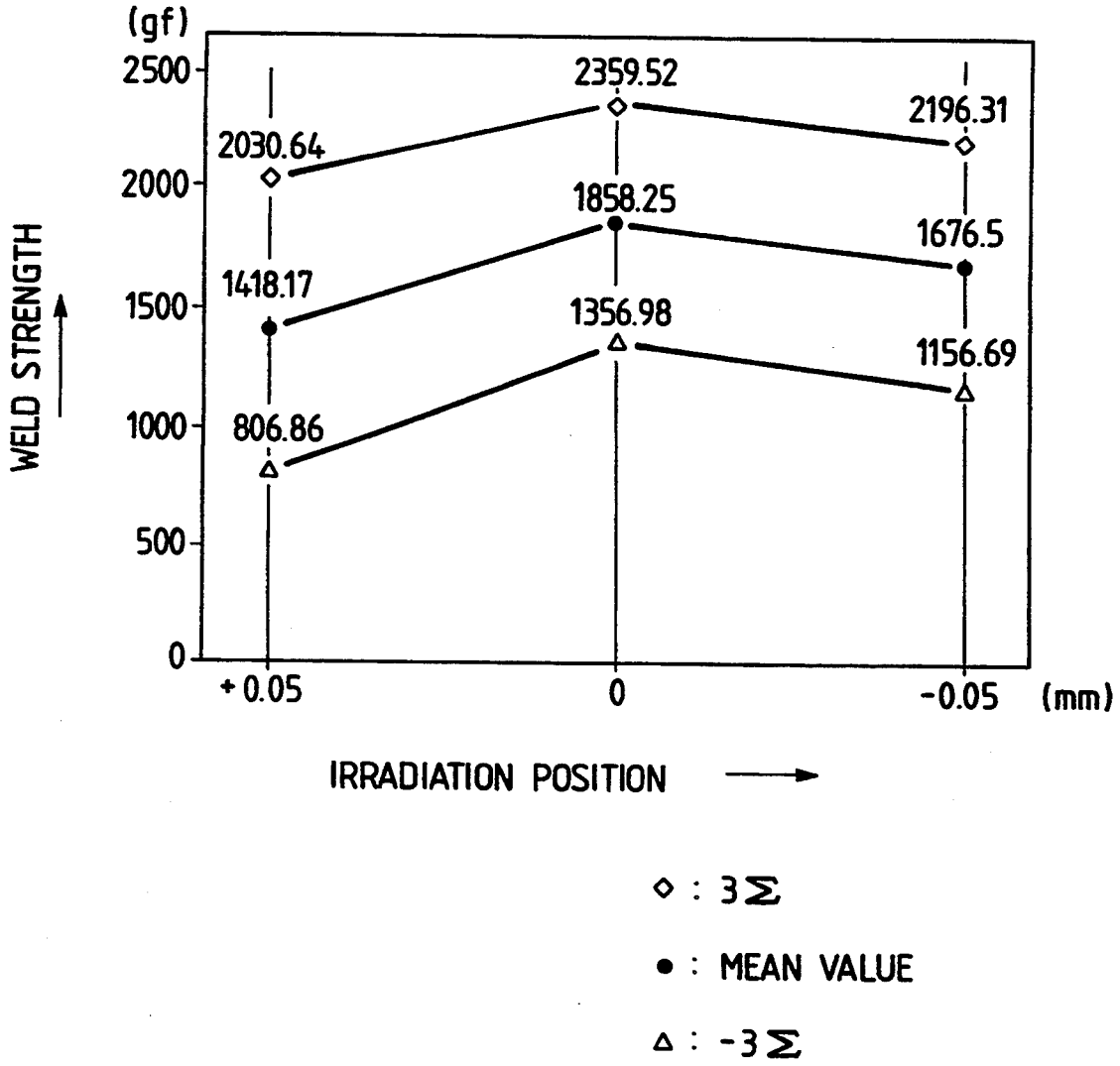
FIG. 16 is a characteristic diagram showing the correlation between the laser beam irradiation positions and the weld strengths explained referring to FIG. 13.

FIG. 1 is a perspective view showing an embodiment of the sliding contact producing method according to the present invention. FIG. 2 is a perspective view showing the state where a beam welding is performed for a sliding contact. FIG. 3 is a cross sectional view showing the state where a beam welding is performed for the main portion of a sliding contact. FIG. 4 is a perspective view showing a resilient metal plate sheared in a predetermined shape. In FIGS. 1 to 3, like numerals are given to those identical to elements shown in FIGS. 13 and 14. Numeral 6 represents a noble metal ball and 8 represents a YAG laser beam.

According to the sliding contact producing method of the present invention, as shown in FIG. 1, a hooplike metal plate 12 with a plurality of feeding index holes 11 and a positioning jig with a plurality of protrusions 13 inserted in the feeding index holes 11 are prepared. A plurality of recess portions 15 for receiving parts of the noble metal balls are formed in the upper surface of the positioning jig 14 to position them. The metal plate 12, as shown in FIG. 3, has recess portions 16 for receiving other parts of the noble metal balls 6 in the lower surface thereof. The recess portions 16 are formed in a bowl shape with a curved surface so as to partially contact the noble metal ball 6 through a press processing. Protruding portions 17 in bowl shape are formed in the upper surface of the metal plate 12.

According to the producing method of the embodiment, as shown in FIG. 1, the noble metal balls 6 are placed in the recesses 15 of the positioning jig 14. Then the metal plate 12, as shown in FIG. 2, are arranged on the positioning jig 14 while parts of the noble metal balls contact to the recesses 16 of the metal plate 12. The metal plate 12 is arranged at a predetermined position with respect to the positioning jig 14 by inserting respectively the protrusions 13 of the positioning jig 14 into the feed indexes 11 of the metal plate 12. Next, YAG laser beam 8 is irradiated onto the metal plate 12 while traveling in parallel with the chain of the protrusions 17, or, in the direction of the arrow 8a shown in FIG. 2 to irradiate sequentially the protrusions 17. With this process, irradiation heat created by the YAG laser beam 8a fuses the metal plate 12 while it conducts to the noble metal ball 6 by way of the contact point. As a result, since the noble metal ball 6 melts, the metal plate 12 and the noble metal ball are welded to each other at the contact point. Thus, as shown in FIG. 4, after the metal plate 12 has been connected with the noble metal balls 6 by beam welding, resilient strips 18 are formed by cutting the resilient metal plate 12 in a predetermined shape.

In the structure of the present embodiment, since the laser beam 8 is received by the metal plate 12 wider than the resilient strip 18, it cannot hit the positioning jig 14. Hence the positioning jig 14 can be prevented from any damage during the beam welding. Since the noble metal ball 6 is partially received in the recess portion 16 of the metal plate 12, it is possible to achieve easily a positioning between the metal plate 12 and the noble metal ball 6. Moreover, the recess portion 16 in bowl shape can propose a contact area between the recess portion 16 and the noble metal ball 6 which is wider than that of the conventional one. Even if the YAG laser beam 8 deflects somewhat from a reference point, the irradiation heat thereof can be conducted suitably to the noble metal ball 6 via the contact area. As a result, weld strength can be sufficiently achieved between the resilient strip 18 of the metal plate 12 and the noble metal ball 6.

According to the experimental results carried out by the present inventor, when the metal plate 12 is made of phosphor bronze and the noble metal ball 6 is made of a noble metal such as Pt, Pd, Ag, Cu, Au, Ir, or the like, it was found that it is possivle to avoid splashing during laser welding, in comparison with the resilient material strip being made of german silver or titanic copper, thus resulting in good weldability.

Figure 5:
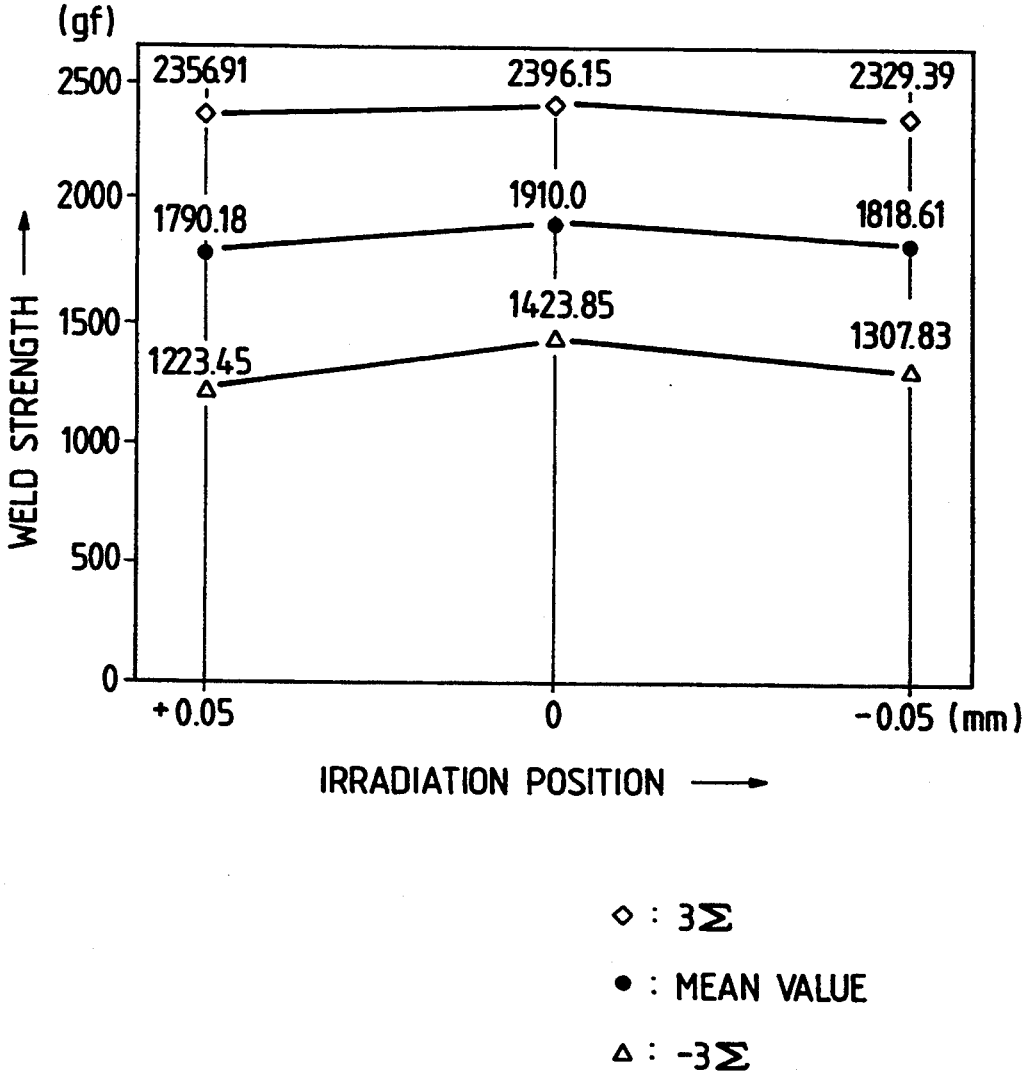
FIG. 5 is a characteristic diagram showing the correlation between laser beam irradiation positions and weld strengths explained with FIG. 3.

FIG. 5 is a characteristic diagram showing the correlation between laser beam irradiation position and weld strength which was obtained by experiments carried out by the present inventor. In the figure, the ordinate axis indicates weld strengths between the resilient strip 18 and the noble metal ball 6 and the abscissa axis indicates irradiation positions of the YAG laser beam 18. In the irradiation position, the reference position (o) is one where a straight line runs through the center P1 of the recess portion 16 and the center C of the noble metal ball 6. The positive side (+) indicates that the irradiation beam shifts in the elongate direction of the resilient strip 18 and toward the supporting side thereof (to the right side in FIG. 3) and the negative side (−) indicates that the irradiation beam shifts toward the front end of the resilient strip 18 (to the left side in FIG. 3).

In comparison with average values shown with black dots in FIG. 5, when the YAG laser beam 8 is irradiated onto the center P1 of the recess portion 16, that is, at the reference position, the weld strength is 1910.0 gf. When the irradiation position of the YAG laser beam 8 shifts toward elongate direction of the resilient strip 18 and toward the front end (−) by 0.05 mm, the weld strength decreases to 1790.18 gf. Even if the irradiation position of the YAG laser beam 8 shifts somewhat from the reference position, the weld strength between the resilient strip 18 and the noble metal ball 6 is maintained in spite of its relatively small sag. For that reason, the weld strength can be obtained sufficiently between the resilient metal strip 12 and the noble metal ball 6.

Figure 6:
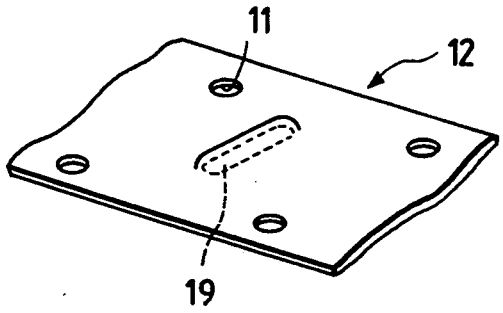
FIG. 6 is a diagram showing an modified embodiment of the metal plate used in the manufacturing method according to the present invention.

According to the present embodiment, the recess portions 16 of the resilient metal plate 12 are formed in bowl shape through press processing. However, a plurality of bowllike recess portions may be formed by cutting the base surface of the resilient metal plate 12. As shown in FIG. 6, a semi-cylindrical recess portion 19 for receiving a plurality of noble metal balls 6 may be formed along the traveling direction of the YAG laser beam 8, by applying a press process to the resilient metal plate 12. The semi-cylindrical recess portion may be formed by cutting a base surface of the resilient metal plate 12.

Figure 7:
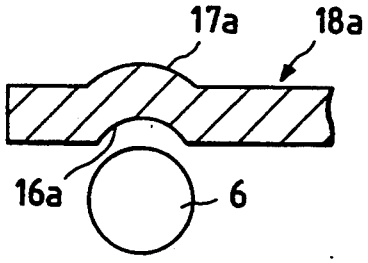
FIG. 7 is a cross-sectional view illustrating another embodiment of the sliding contact according to the present invention.
Figure 8:
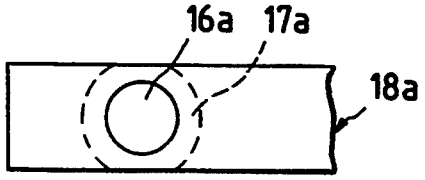
FIG. 8 is a view showing the base portion of the resilient strip attached to the sliding contact in FIG. 7.

FIGS. 7 and 8 show another embodiments according to the present invention. FIG. 7 is a cross sectional view showing a sliding contact. FIG. 8 is a diagram viewed from the base surface of a resilient strip attached on the sliding contact in FIG. 7. The difference from the above first embodiment is that after the resilient strip 18a is formed by making slits in a metal plate through press processing, noble metal balls 6 are arranged respectively in the bowllike recess portions **16*a* formed at the front ends of the resilient strips 6** to perform laser welding.

Figure 9A:
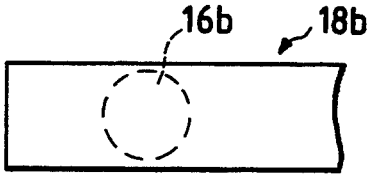
FIGS. 9(*a*) and 9(*b*) are top and longitudinal section views showing a modified embodiment of a resilient strip attached to the sliding contact according to the present invention.
Figure 9B:
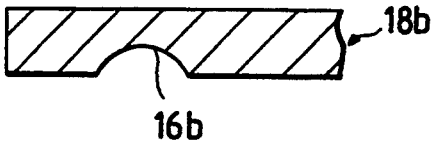
Figure 10A:
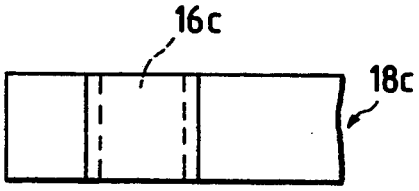
FIGS. 10(*a*) and 10(*b*) are top and longitudinal section views showing another embodiment of a resilient strip attached to the sliding contact according to the present invention.
Figure 10B:
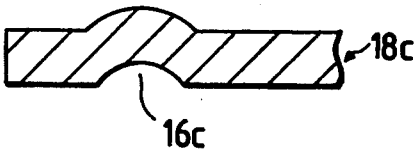
Figure 11A:
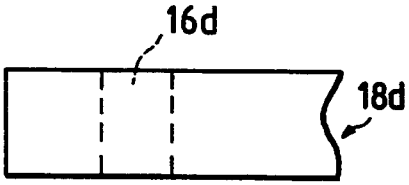
FIGS. 11(*a*) and 11(*b*) are top and longitudinal section views showing still another embodiment of a resilient strip attached to the sliding contact according to the present invention.
Figure 11B:
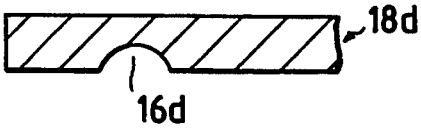
Figure 12:
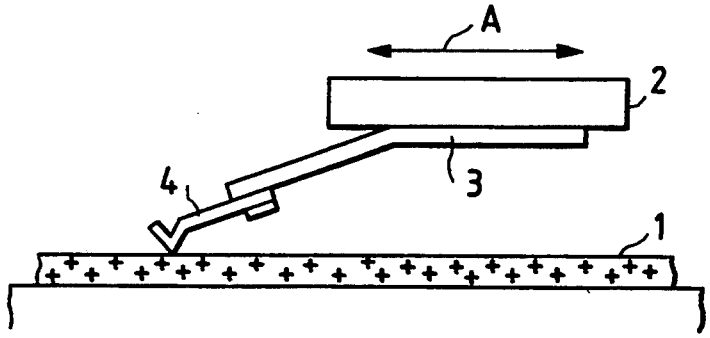
FIG. 12 PRIOR ART
FIG. 12 is a side view showing a conventional sliding contact.

In the above embodiments, the recess portions **16*a* of the resilient strips 18*a* are formed in bowl shape by performing a press process. However, as shown in FIGS. 9**(*a*) and 9(*b*), the bowllike recess portions **18*a* may be formed by subjecting the base surface of the resilient stripe 18*b* to a cutting process. As shown in FIGS. 10**(*a*) and 10(*b*), a press molding to the resilient strip **18*c* can effectively form a semi-cylindrical recess portions 16*c* along the width of the resilient strip 18*c* to irradiate the YAG laser beam 8 to the resilient strip 18*c* along the width thereof. Furthermore, as shown in FIGS. 11**(*a*) and 11(*b*), the semi-cylindrical recess portions of the resilient strip **18*d* can be formed by subjecting the base surface of the resilient strip 18*d*** to a cutting process.

As described above, according to the sliding contact producing method of the present invention, the positioning between noble metal balls and a metal plate can be easily achieved. The strong weld strength between the noble metal ball and the metal plate can improve the operation efficiency of welding the resilient strip and noble metal contact and the reliability of welded portions. Furthermore, since a metal plate being wider than that of the resilient strip receives beam, the beam does not reach a jig mounting noble metal contacts, whereby the metal contact mounting jig can be prevented from damage due to beam welding.

What is claimed is:

1. A method for producing a sliding contact, comprising the steps of:

a) forming a plurality of recess portions, each having a curved surface, in a metal plate;

b) contacting parts of noble metal contacts to said recess portions; and c) bonding said noble metal contacts to said metal plate by beam welding; and then d) machining the metal plate to form resilient strips.

2. A sliding contact producing method according to claim 1, wherein said noble metal contacts are formed in a ball shape and wherein said recess portions have a bowllike form substantially similar to the outline of said noble contacts.

3. A sliding contact according to claim 1, wherein said resilient strips each have a recess portion in the front end thereof.

4. A sliding contact producing method according to claim 1, wherein each of said noble metal contacts is directly bonded to each of said resilient strips by irradiating beam to a back surface opposite to the surface where each of said noble metal of each of said resilient strips contacts is arranged.

5. A sliding contact producing method according to claim 4, wherein said beam-welding is carried out using a laser beam.

6. A sliding contact producing method comprising the steps of:

a) arranging a plurality of noble metal contacts on a b) arranging a metal plate of resilient material on said noble metal contacts;

c) irradiating a beam onto said metal plate adjacent said noble metal contacts to weld directly said noble metal contacts to said metal plate; and d) machining said metal plate so as to form a slit surrounding each of said noble metal contacts to make a resilient strip of said metal plate.

7. A sliding contact producing method according to claim 6, further comprising the step of arranging said plurality of noble metal contacts in straight line over said jig; and forming a slit so as to be perpendicular to said straight line.

8. A sliding contact producing method according to claim 6, wherein said beam is a laser beam.

9. A sliding contact producing method comprising the steps of:

a) arranging a plurality of recess portions each having a curved surface in a metal plate of resilient material;

b) arranging a plurality of noble metal contacts over a jig so as to contact partially said noble metal contacts with said curved surfaces;

c) irradiating a beam against said metal plate to bond directly said noble contacts to said metal plate; and d) machining said metal plate so as to form a slit surrounding each of said noble contacts to make a resilient strip from said metal plate.

10. A sliding contact producing method according to claim 9, wherein said noble metal contacts each are formed in a ball form and wherein said recess portions each have a bowllike form substantially similar to the outline of said noble contacts.

11. A sliding contact producing method according to claim 9, wherein said noble metal contacts each are formed in a ball form and wherein said recess portions for receiving a metal material each have a bowllike form.

12. A sliding contact producing method according to claim 11, wherein said beam is a laser beam.

13. A sliding contact producing method according to claim 12, further comprising the step of arranging said plurality of noble metal contacts in straight line over said jig; and forming slits so as to be perpendicular to said straight line.

* * * * *